United States Patent [19]

Wang

[11] Patent Number: 5,076,181

[45] Date of Patent: Dec. 31, 1991

[54] THREADING APPARATUS FOR A LOWER LOOPER OF AN OVERLOCK SEWING MACHINE

[76] Inventor: Shui-Nu Wang, No. 6, Nan Pin Road, Taichung, Taiwan

[21] Appl. No.: 676,338

[22] Filed: Mar. 28, 1991

[51] Int. Cl.[5] ..... D05B 57/00

[52] U.S. Cl. ..... 112/199; 112/162; 112/302

[58] Field of Search ..... 112/154, 159, 162, 166, 112/172, 177, 197, 199, 202, 270, 224, 225, 302, 262.1, 268.1, 269.1

[56] References Cited

U.S. PATENT DOCUMENTS

| | | | |
|---|---|---|---|
| 541,518 | 6/1895 | Woodward | 112/165 |
| 2,778,329 | 1/1957 | Howell et al. | 112/199 |
| 3,333,560 | 8/1967 | Wiener et al. | 112/199 |
| 4,649,843 | 3/1987 | Muroi et al. | 112/270 |
| 4,977,842 | 12/1990 | Fukao et al. | 112/199 |

*Primary Examiner*—Werner H. Schroeder
*Assistant Examiner*—Paul C. Lewis

[57] ABSTRACT

A threading device for threading a lower looper of an overlock sewing machine, an orifice and a slot are formed in an arm of the lower looper, a hook if formed on a rear end of the arm and obliqued from the arm at a sharp angle, a holder is formed on one end of a lever, a thread threaded through the orifice of the arm can be carried by the holder toward the rear end of the arm, the thread will slip over the hook and located behind the hook when the holder moves beyond the hook, and the thread can be hooked by the hook and received in the slot of the arm when the lever is released.

1 Claim, 4 Drawing Sheets

THREADING APPARATUS FOR A LOWER LOOPER OF AN OVERLOCK SEWING MACHINE

BACKGROUND OF THE INVENTION (a) Field of the Invention

The present invention relates to a threading apparatus, and more particularly to a threading apparatus for a lower looper of an overlock sewing machine.

(b) Description of the Prior Art

An overlock sewing machine which is commercially available at present comprises an arm disposed on a base and a needle extending downward from a free end portion of the arm for conducting sewing operations. The overlock sewing machine is provided for forming a hem or a selvage on the edge portions of a piece of cloth and comprises an upper looper and a lower looper pivotally disposed in the base thereof and operatable in a reciprocating or oscillating action. The upper looper and the lower lopper are engageable with each other. Each of the upper looper and the lower lopper carries a thread, and the threads can be engaged with each other during sewing operations.

A conventional lower looper is shown in FIG. 8 and comprises a bar 90 having a lower end pivotally supported in the base of the sewing machine by an ankle 91, a catch 92 fixed on an upper end of the bar 90, and a guide 97 fixed on the middle portion of the bar 90. A hole 98 is formed in the guide 97. The catch 92 includes a straight arm 93 formed on the upper end of the catch 92 and substantially perpendicular to the bar 90. A slot 94 is formed in one side of the arm 93. An orifice 95 is formed in the front end of the arm 93 and is communicated with the slot 94. A conduit 96 is formed in the rear end of the arm 93 and is communicated with the slot 94. A thread 99 passes through the hole 98 of the guide 97 and is threaded into the conduit 96, and then passes through the orifice 95 so that the portion of the thread 99 located between the orifice 95 and the channel 96 can be received in the slot 94 and so that this portion of the thread 99 will not be interfered during sewing operations.

However, in order to be operated precisely and accurately, the arm 93 is preferably made as thin as possible so that the size of the conduit 96 should be very small. This causes difficulty for threading the thread 99 through the conduit 96 of the arm 93.

The present invention has arisen to mitigate and/or obviate the afore-described disadvantages of the conventional overlock sewing machine.

SUMMARY OF THE INVENTION

The primary objective of the present invention is to provide a threading apparatus which can thread the lower looper of an overlock sewing machine easily.

In accordance with one aspect of the present invention, there is provided a threading apparatus for a lower looper of an overlock sewing machine, the lower looper has a lower end pivotally supported in a base of the overlock sewing machine and has an arm formed on an upper end, a slot is formed in one side surface of the arm, an orifice is formed in a front end of the arm and is communicated with the slot, the threading apparatus includes a hook formed on a rear end portion of the arm and obliqued from the arm at a sharp angle, a lever has a middle portion rotatably coupled to a middle portion of the lower looper by an axle and has a holder formed on one end, a spring is disposed on the axle for biasing the lever to rotate in one direction relative to the axle, the holder has two leg portions, a notch is formed in each of the leg portions of the holder, a thread engaged in the notches of the holder and threaded through the orifice of the arm can be carried by the holder toward the rear end portion of the arm when the lever is rotated against the spring, the thread will slip over the hook and move to a position located behind the hook when the holder moves beyond the hook, and the thread can be hooked by the hook and received in the slot of the arm when the lever is released.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
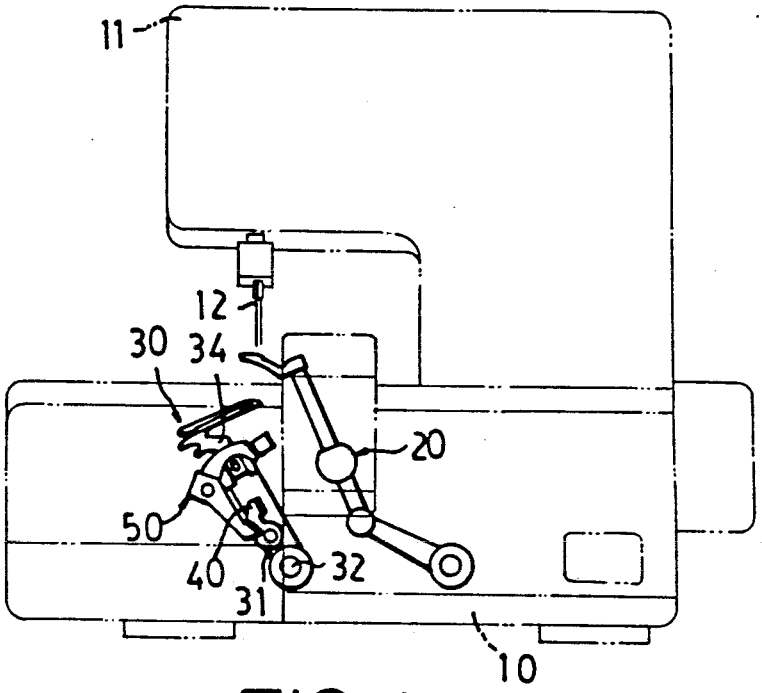
FIG. 1 is a plane view of an overlock sewing machine.

Referring to the drawings and initially to FIG. 1, an overlock sewing machine comprises a member 11 disposed on a base 10, a needle 12 extending downward from a free end portion of the member for conducting sewing operations, and an upper looper 20 and a lower looper 30 pivotally disposed in the base 10 thereof. A threading apparatus in accordance with the present invention is generally disposed on the lower looper 30 and is provided for threading the lower looper 30.

Figure 2:
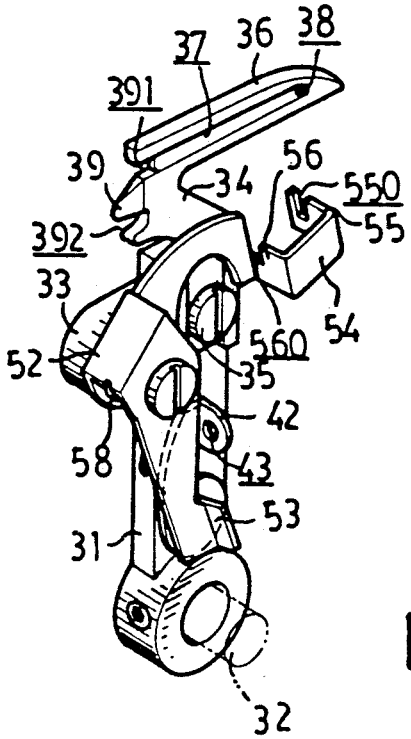
FIG. 2 is a perspective view of a threading apparatus in accordance with the present invention.
Figure 3:
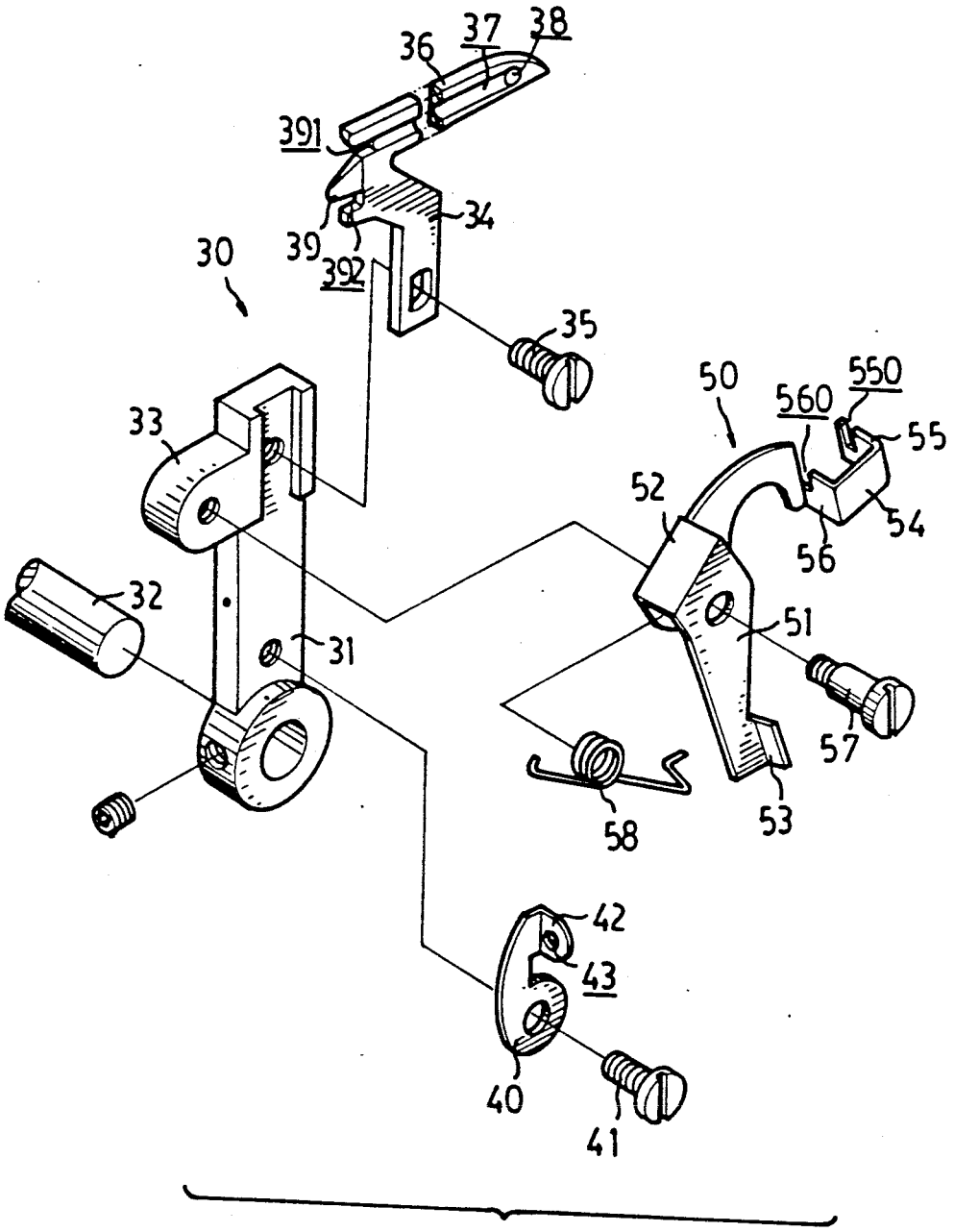
FIG. 3 is an exploded view of the threading apparatus.

Referring next to FIGS. 2 and 3, the lower looper 30 comprises generally a bar 31 having a lower end pivotally supported in the base 10 of the overlock sewing machine, and a catch 34 having a lower end fixed to the upper end of the bar 31 by such as a bolt 35. A lug 33 is integrally formed on one side of the upper portion of the bar 31. A straight arm 36 is formed on the upper portion of the catch 34 and is substantially perpendicular to the bar 31. A slot 37 is formed in one side of the arm 36. An orifice 38 is formed in the front end of the arm 36 and is communicated with the slot 37. A hook 39 is formed on the rear end portion of the arm 36. Preferably, an opening 391 is formed above the hook 39 and is communicated with the slot 37, and an opening 392 is formed beneath the hook 39. As is best shown in FIG. 6, the hook 39 obliques from the arm 36 at an angle, especially a sharp angle.

A guide 40 is fixed to the lower portion of the bar 31 by such as a bolt 41. An ear 42 extends from the upper end of the guide 40 and is substantially perpendicular to the guide 40. A hole 43 is formed in the ear 42. The threading apparatus 50 includes an L-shaped lever 51 having a U-shaped portion 52 formed in the middle portion thereof and having a handle portion 53 formed on one end thereof. A U-shaped holder 54 is integrally formed on the other end of the lever 51. A notch 550, 560 is formed in each of the two leg portions 55, 56 of the holder 54. The U-shaped middle portion 52 of the lever 51 is rotatably supported on a bolt 57 which is threaded to the lug 33 of the bar 31. A spring 58 is engaged on the bolt 57 and is provided for biasing the lever 51 to rotate in one direction. One end of the spring 58 is engaged on the U-shaped middle portion 52 of the lever 51 and the other end of the spring 58 is engaged in the bar 31.

Figure 5:
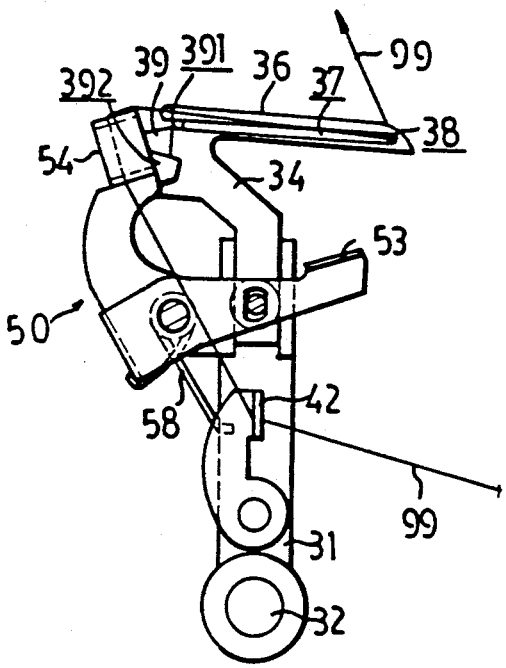
FIGS. 4 and 5 are plane views illustrating the threading operations of the threading apparatus.
Figure 4:
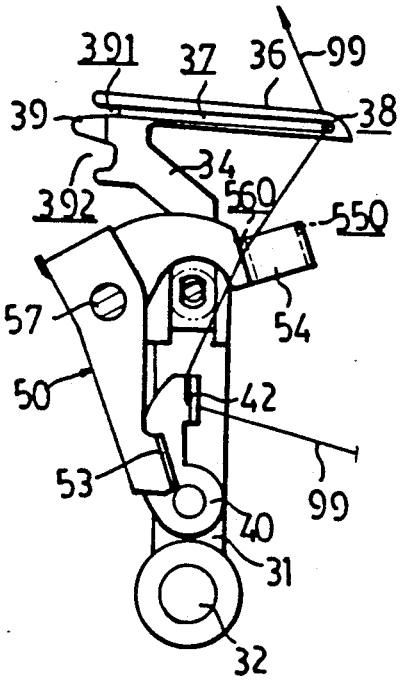
Figure 6:
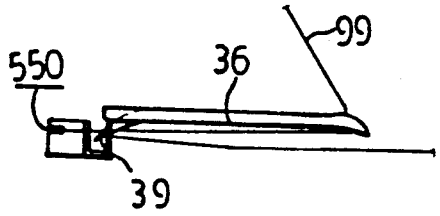
FIG. 6 is a top elevational view of the threading apparatus as shown in FIG. 5.

In operation, as shown in FIGS. 4 to 6, initially, the lever 51 is biased by the spring 58 to the position as shown in FIG. 4. At this moment, the holder 54 is located between the orifice 38 of the arm 36 and the hole 43 of the ear 42 of the guide 40. Since the orifice 38 and the hole 43 can be made as large as possible, the thread 99 can be easily threaded through the orifice 38 and the hole 43 manually. When the thread 99 is tensioned, the segment of the thread 99 located between the orifice 38 and the hole 43 can be automatically engaged in the notch 560 of the holder 54, or can be easily engaged in the notch 560 manually. When the handle portion 53 of the lever 51 is pulled by a user, the thread 99 can be engaged in the notches 550, 560 of the holder 54 and can be carried by the holder 54 to the position as shown in FIG. 5.

Figure 7:
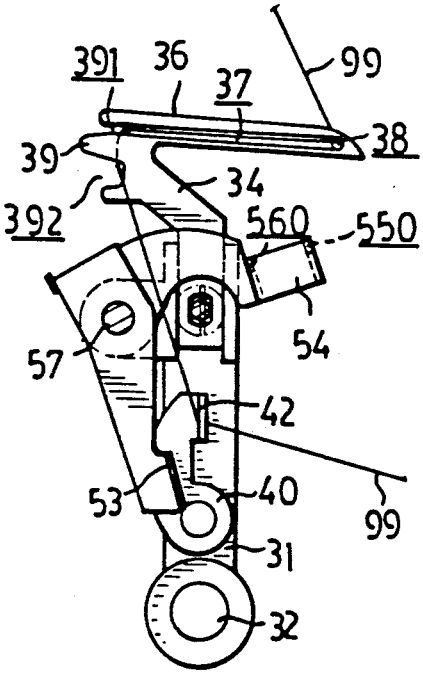
FIG. 7 is a plane view of the threading apparatus, in which the thread has been threaded in position.
Figure 8:
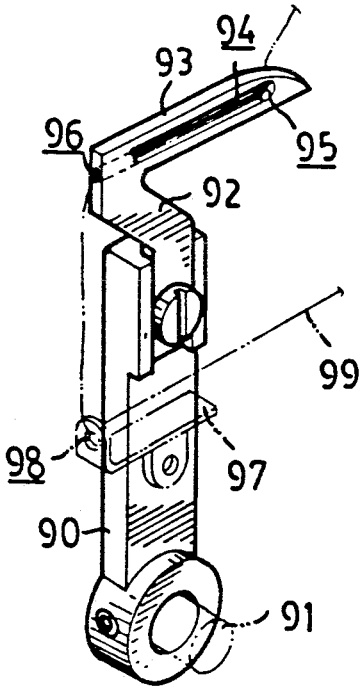
FIG. 8 PRIOR ART
FIG. 8 is a perspective view illustrating a conventional lower looper of the overlock sewing machine.

When the holder 54 moves beyond the hook 39, the thread 99 carried between the leg portions 55, 56 of the holder 54 will slip over the hook 39 and will move to a position located behind the hook 39. The lever 51 will be recovered and will be biased to rotate in a reverse direction to the position as shown in FIG. 4 or FIG. 7 when the handle portion 53 of the lever 51 is released, at this moment, as shown in FIG. 7, the thread will be hooked by the hook 39 and engaged in the openings 391, 392 so that the thread 99 can be received in the slot 37 of the arm 36.

Accordingly, the threading apparatus in accordance with the present invention can thread the lower looper of the overlock sewing machine easily.

Although this invention has been described with a certain degree of particularity, it is to be understood that the present disclosure has been made by way of example only and that numerous changes in the detailed construction and the combination and arrangement of parts may be restored to without departing from the spirit and scope of the invention as hereinafter claimed.

I claim:

1. A threading apparatus for a lower looper of an overlock sewing machine, said lower looper having a lower end pivotally supported in a base of said overlock sewing machine and having an arm formed on an upper end thereof, a slot formed in one side surface of said arm, an orifice formed in a front end of said arm and communicating with said slot, said threading apparatus comprising a hook formed on a rear end portion of said arm and obliqued from said arm at an angle, a first opening formed above said hook and communicating with said slot of said arm, a second opening formed beneath said hook, a lever which is substantially L-shaped having a middle portion rotatably coupled to a middle portion of said lower looper by an axle and having a holder formed on a first end thereof, said lever having a U-shaped portion formed on said middle portion thereof, a spring disposed on said axle and disposed in said U-shaped portion of said lever, one end of said spring engaged on said U-shaped portion of said lever and the other end of said spring engaged in said lower looper so that said lever can be biased to rotate in one direction relative to said axle, said holder having two leg portions, a notch formed in each of said leg portions of said holder, a thread engaged in said notches of said holder and threaded through said orifice of said arm can be carried by said holder toward said rear end portion of said arm when said lever is rotated against said spring, said thread will slip over said hook and move to a position located behind said hook when said holder moves beyond said hook, and said thread can be hooked by said hook and can be engaged in said first opening and said second opening and can be received in said slot of said arm when said lever is released.

* * * * *